US010618090B2

(12) United States Patent
Polk

(10) Patent No.: US 10,618,090 B2
(45) Date of Patent: Apr. 14, 2020

(54) METHOD FOR PRODUCING A THICKNESS-PROFILED METAL STRIP

(71) Applicant: VOESTALPINE KREMS GMBH, Krems an der Donau (AT)

(72) Inventor: Markus Polk, Tulln (AT)

(73) Assignee: voestalpine Krems GmbH, Krems an der Donau (AT)

( * ) Notice: Subject to any disclaimer, the term of this patent is extended or adjusted under 35 U.S.C. 154(b) by 0 days.

(21) Appl. No.: 15/534,474

(22) PCT Filed: Dec. 9, 2015

(86) PCT No.: PCT/AT2015/050310
§ 371 (c)(1),
(2) Date: Jun. 8, 2017

(87) PCT Pub. No.: WO2016/090399
PCT Pub. Date: Jun. 16, 2016

(65) Prior Publication Data

US 2017/0348746 A1 Dec. 7, 2017

(30) Foreign Application Priority Data

Dec. 9, 2014 (AT) ..... A50891/2014

(51) Int. Cl.
*B21B 1/08* (2006.01)
*B21B 37/16* (2006.01)
(Continued)

(52) U.S. Cl.
CPC ..... *B21B 37/165* (2013.01); *B21B 1/0805* (2013.01); *B21B 1/22* (2013.01); *B21H 8/00* (2013.01)

(58) Field of Classification Search
CPC ..... B21B 1/08; B21B 1/0805; B21B 1/22; B21B 2263/00; B21B 2263/02; B21B 2261/043; B21C 37/02; B21H 8/00
(Continued)

(56) References Cited

U.S. PATENT DOCUMENTS 4,528,836 A 7/1985 Durand-Texte
5,351,397 A * 10/1994 Angeli ..... B21B 1/227 29/890.046

FOREIGN PATENT DOCUMENTS

DE 3622926 A1 3/1987
DE 19748321 A1 5/1998
(Continued)

OTHER PUBLICATIONS

EP 1430973A1 Machine Translation.*

*Primary Examiner* — Debra M Sullivan

(57) ABSTRACT

A method for producing a thickness-profiled metal strip in which at least one opening is produced in the metal strip and in a subsequent step, the metal strip is longitudinally rolled with at least one roller that penetrates into the metal strip in some regions across its strip width and thus a thickness profiling at least in the width direction of the metal strip is produced. In order to improve the reproducibility of the method, what is proposed is that at least one hole passing through the metal strip is produced as an opening in the metal strip, over which hole the roller that penetrates into the metal strip longitudinally rolls in order to produce the thickness profiling in the width direction of the metal strip.

13 Claims, 3 Drawing Sheets

(51) Int. Cl.
*B21H 8/00* (2006.01)
*B21B 1/22* (2006.01)

(58) Field of Classification Search
USPC ..... 72/377, 226, 234
See application file for complete search history.

(56) References Cited

FOREIGN PATENT DOCUMENTS

| | | | |
|---|---|---|---|
| DE | 10113610 | A1 | 10/2002 |
| DE | 10156087 | A1 | 6/2003 |
| DE | 102006024775 | A1 | 11/2007 |
| EP | 0976462 | A2 | 2/2000 |
| EP | 1430973 | A1 | 6/2004 |
| JP | S5973103 | U | 5/1984 |
| JP | S606234 | A | 1/1985 |
| WO | 2012119166 | A1 | 9/2012 |

* cited by examiner

METHOD FOR PRODUCING A THICKNESS-PROFILED METAL STRIP

FIELD OF THE INVENTION

The invention relates to a method for producing a thickness-profiled metal strip in which at least one opening is produced in the metal strip and in a subsequent step, the metal strip is longitudinally rolled with at least one roller that penetrates into the metal strip in some regions across its strip width and thus at least one thickness profiling in the width direction of the metal strip is produced.

BACKGROUND OF THE INVENTION

In order to be able to produce a homogeneous transition between different thicknesses of a metal strip in the width direction, it is known from the prior art (WO2012119166A1) to permit at least one peripheral working roll or flat roller to penetrate into the metal strip across its strip width during the longitudinal rolling. In addition, before this roll pass, the rolling stock or metal strip is provided with grooves, which as an opening in the metal strip, encourage a flow of material in the width direction of the strip material and thus counteract a flow of material in its longitudinal direction. Nevertheless—particularly depending on the width of the flat roller—an uneven flow of material can occur in the longitudinal direction of the metal strip, which can result in rippling in the strip.

The intent of EP976462A2 is to avoid such rippling in the strip by using—instead of a flat roller—a plurality of profiled rollers that are staggered relative to one another in the width direction and situated one after another in the longitudinal direction, namely pressing rollers, which penetrate into the metal strip in some regions. Providing a plurality of rollers, however, requires an increased design and control expense—such multiple-roller designs are also generally sensitive to geometrical irregularities in the metal strip, which can reduce the reproducibility of the thickness profiling method.

SUMMARY OF THE INVENTION

The object of the invention, therefore, is to create a method for producing a thickness-profiled metal strip of the type explained at the beginning, which excels due to its simplicity and high reproducibility.

The invention attains the stated object in that at least one hole passing through the metal strip is produced as an opening in the metal strip, over which hole the roller that penetrates into the metal strip longitudinally rolls in order to produce the thickness profiling in the width direction.

If at least one hole passing through the metal strip is produced as an opening in the metal strip, over which hole the roller that penetrates into the metal strip longitudinally rolls in order to produce the thickness profiling in the width direction, then it is possible to significantly improve the reproducibility of the method as compared to known methods. Specifically in the rolling region, this special material cut-out in the metal strip can ensure a reduction or even stopping of the flow of material in the longitudinal direction of the metal strip, which counteracts an uneven length expansion and can thus prevent rippling in the strip. This applies even if the metal strip is rolled longitudinally in a roll pass with a comparatively wide rolling region and there is thus a particularly high risk of an uneven flow of material across the width of the metal strip or rolling stock. In other words: the through hole in the rolling region of the roller that penetrates into the metal strip is geometrically embodied so that the rolling-induced flow of material in the longitudinal direction of the metal strip can be reduced, thus making it possible to reduce the formation of irregularities in the longitudinal expansion. In addition, the hole in the rolling region can contribute to compensating for irregularities in the metal strip that is to be rolled, in order to accommodate increased flow of material, which can make the method according to the invention more tolerant of parameter fluctuations and thus further improve its reproducibility.

In general, it should be noted that the volume removed by means of the holes in the metal strip should advantageously at least correspond to the material volume that flows in the longitudinal direction of the metal strip due to the longitudinal rolling.

A through hole can be produced in the metal strip with comparative ease in terms of method if it is punched into the metal strip.

If at least one row of holes with a plurality of through holes is produced in the longitudinal direction of the metal strip, then it is possible to reliably prevent rippling in the strip even over a relatively long metal strip. To be precise, these repeating holes can successively compensate for a longitudinal material flow along the forming region, which can make it possible to correspondingly carry out a complete forming of the metal strip in one roll pass. It is thus possible to enable a continuous longitudinal rolling in order to produce a metal strip that is thickness-profiled at least in the width direction, which can be used, for example, in an in-line process. In addition, a row of holes can permit a comparatively high degree of deformation in the metal sheet in order to accelerate the method, for example by increasing the speed of the strip.

The hole diameter of the holes can be reduced if at least two through holes of a row of holes are produced in the metal strip offset in the width direction of the metal strip. Such a reduced hole diameter can, for example, result in a small gap size in the rolled hole, which can thus facilitate a subsequent material-adhesion joining of the through hole.

The distances between successive through holes of a row of holes can differ in order to selectively rake advantage of the flow of material in the longitudinal direction so as to achieve a rolling-induced closing of the through holes.

For the rolling-induced closing of the through holes, it can also be advantageous if holes with different cross-sectional shapes are produced in the metal strip.

If the longitudinal separation t between the successive through holes is greater than twice the hole width w of the successive holes 13 and less than five times the hole width w of the successive holes, then an easy-to-manage process regulation can be predetermined in order to avoid rippling in the strip.

The process conditions can be further simplified if the metal strip is cold-rolled.

Through holes can be quickly and inexpensively provided in the metal strip if a circular hole and/or an oblong hole is/are produced in the metal strip.

In particular, the method according to the invention can excel if the rolling process is adjusted in such a way that the through hole essentially closes after the longitudinal rolling.

A through hole in the metal strip can be closed again easily in terms of method in that after the longitudinal rolling, the hole is closed through material adhesion by means of joining.

If the roller penetrates into the metal strip by a maximum depth of two thirds of the initial thickness of the metal strip, then it is possible to predetermine a simple process regulation for avoiding rippling in the strip during the thickness profiling of the metal strip.

The thickness-profiled metal strip according to the invention can particularly excel if a plate is cut to length from it.

BRIEF DESCRIPTION OF THE DRAWINGS

An exemplary embodiment of the subject of the invention is depicted in greater detail in the drawings. In the drawings.

DETAILED DESCRIPTION OF THE PREFERRED EMBODIMENTS

Figure 1:
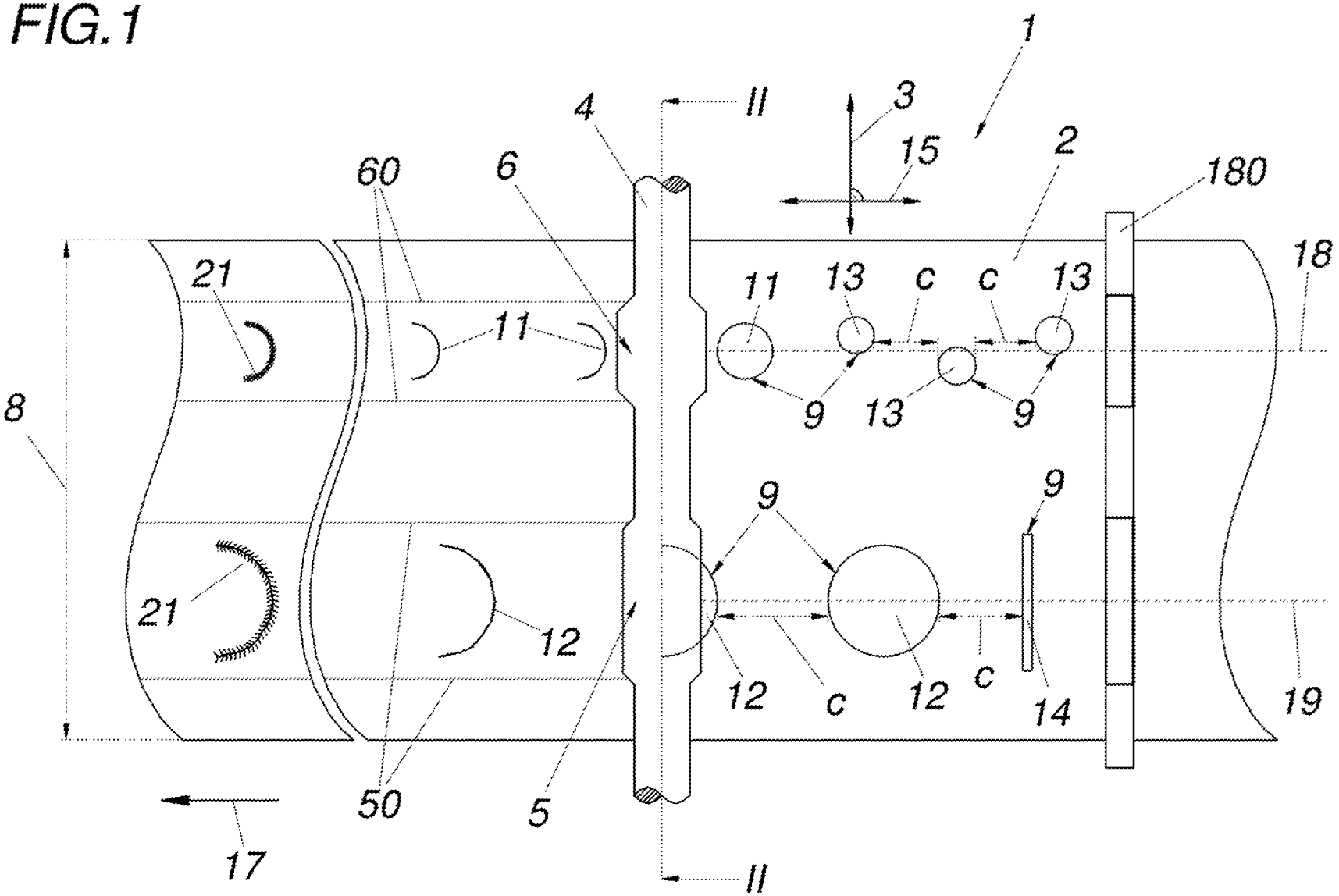
FIG. 1 shows a top view of a production line for carrying out a method for producing a thickness-profiled metal strip.
Figure 2:
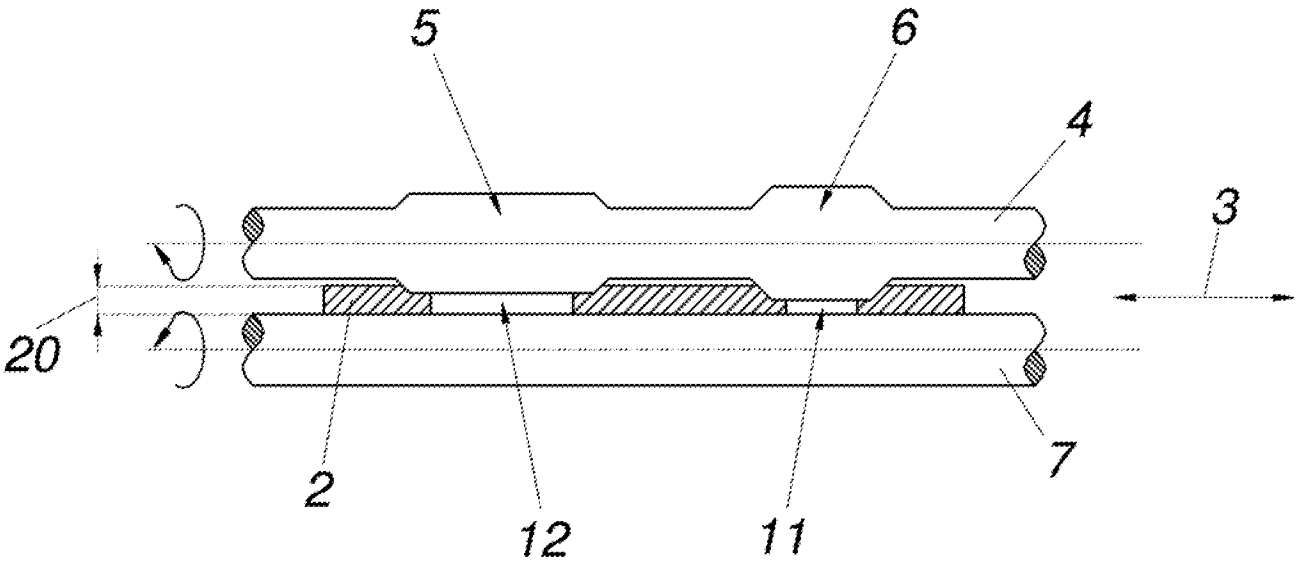
FIG. 2 shows a section along the section line II-II in FIG. 1.

FIG. 1 shows a top view of a continuous rolling line 1 in which a metal strip 1—for example composed of a steel material—is thickness profiled, specifically in its width direction 3. A roller 4 with two cylindrical sections 5, 6 is provided for this purpose. The roller 4 is embodied as a flat longitudinal roller. Although not shown in detail, it is generally just as conceivable, instead of such a flat longitudinal roller, to provide two successive flat longitudinal rollers, each with only one cylindrical section. The flat longitudinal roller 4 cooperates with a mating roll 7 in order to form the roll gaps; the metal strip 2 is rolled longitudinally by means of the roller 4 that protrudes into it in some regions across its strip width 8, namely in two adjacent rolling regions 50, 60. As is particularly clear in FIG. 2, the initial thickness 20 of the metal strip 2 is reduced in these cold-rolled rolling regions 50, 60, which results in a thickness profiling in the width direction 3. As a maximum amount according to the invention, the roller 4 penetrates into the metal strip 2 by a maximum depth of two thirds of the initial thickness 20 of the metal strip 2. The metal strip 2 also has openings 9 in the broad side 10 oriented toward the roller 4, which openings are already present in the metal strip 2 before the longitudinal rolling.

According to the invention, these openings 9 are embodied as holes 11, 12, 13, 14 that extend through the metal strip 2; these holes are produced in the metal strip 2 in a simple manner by means of a cutting process before the longitudinal rolling of the strip. It is thus possible to reduce a material flow of the material of the metal strip 2 in its longitudinal direction 15 that can occur during the longitudinal rolling of a material strip 2. This avoids an uneven longitudinal flow across the strip width 8, which reliably prevents rippling in the strip. The method according to the invention for producing a thickness-profiled metal strip 2 thus features particularly high reproducibility.

In general, it should be noted that the openings 9 can have any hole shape. For example, round holes 11, 12 and a slot 14 are shown in FIG. 1—as needed or required, any cross-sectional shapes are conceivable, for example a slot-shaped, polygonal, rectangular, square, etc. cross-sectional shape.

These openings 9 are punched into the metal strip 2—in an approach that is easy in terms of method—before the longitudinal rolling. This is carried out by means of an indicated punching tool 180, which has a punch and a cooperating female die and is positioned before the roller 4 in the strip advancing direction 17.

As is also apparent from FIG. 1, the openings 9 are provided one after another in the metal strip 2, forming two rows of holes 18, 19. For this purpose, the punching tool 180, with two associated punches for the two rows of holes 18, 19, is used to jointly punch respective pluralities of through holes 11, 13 and 12, 14, which are correspondingly arranged one after another in the longitudinal direction of the metal strip 2.

As is clear from FIG. 1, in the row of holes 18 that is composed of holes 11, 13 arranged one after another in the longitudinal direction, the circular holes 13 succeeding one another in the longitudinal direction are arranged offset in the width direction 3 of the metal strip 2. Consequently, the area of the circular holes 13 can be smaller relative to the area of the preceding hole 11 and a continuous flow of material in the longitudinal direction of the metal sheet 2 can nevertheless be reliably interrupted. This is particularly the case since these offset holes 13 overlap each other, viewed in the longitudinal direction of the metal sheet 2. In addition, the hole spacing c or the distances between the circular holes 13 is/are preferably equidistant and the related hole distribution is uniform.

The hole spacing c between successive through holes 12, 14 of the second row of holes 19 varies or differs, as is apparent from a comparison of the distances between two holes 12 and between the holes 12 and 14.

As is also apparent in FIG. 1 after the roller 4 in the strip advancing direction 17, the rolling process is adjusted so that the through hole 11, 12, 13, 14 essentially closes after the longitudinal rolling. This facilitates a material-adhesion joining subsequent to the longitudinal rolling and results in a stable welding seam 21. Instead of the welding seam 21 shown, it is also conceivable to use a spot weld, hut this is not shown in detail here.

Figure 3:
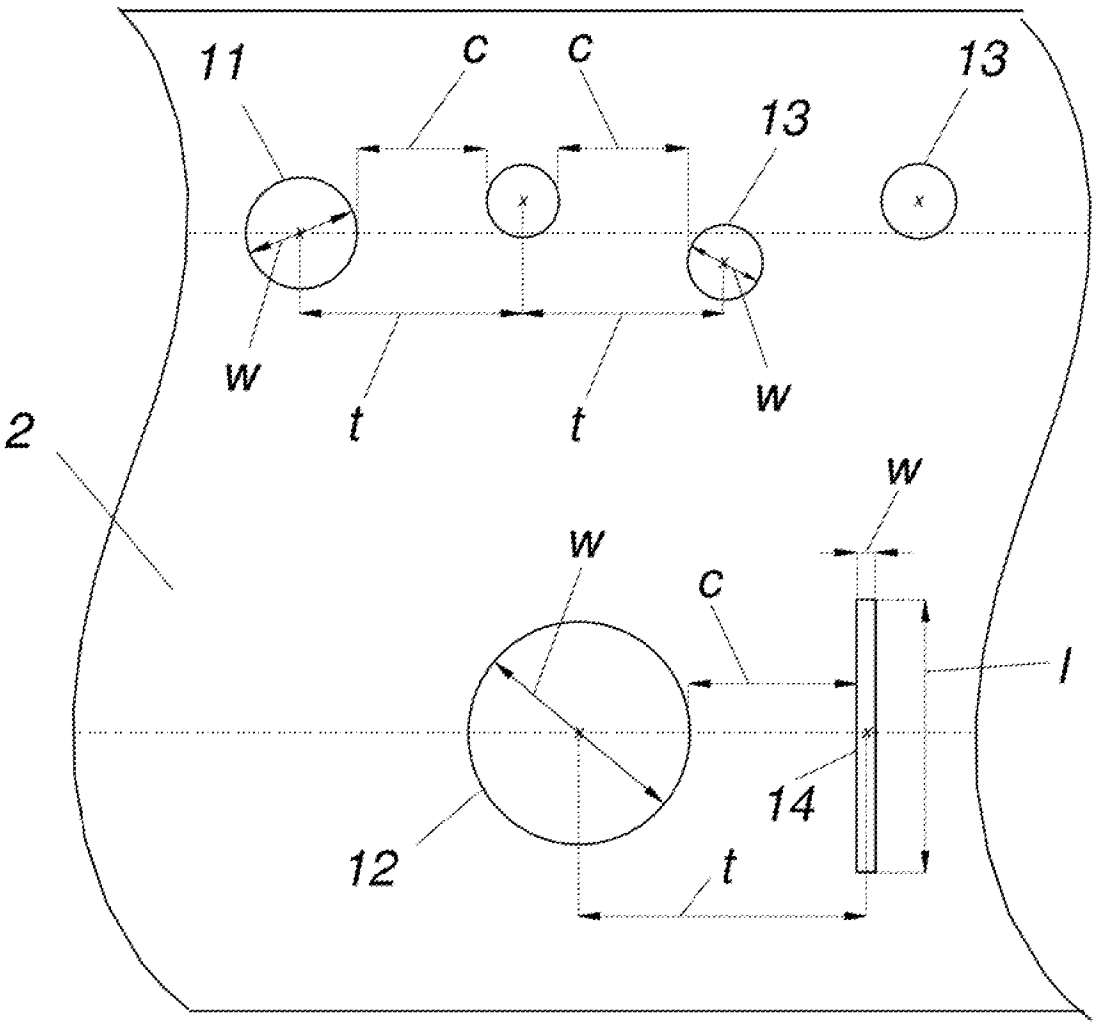
FIG. 3 shows a detail from FIG. 1.

FIG. 3 shows the parameters of the rows of holes 18, 19 in greater detail. To this end, it should be generally noted that the longitudinal separation t is understood to be a center-to-center distance in the longitudinal direction between adjacent holes 11, 13 or 12, 14, the hole width w is understood to be a diameter of a circular hole 11, 12, 13 or the smaller opening dimension of a differently shaped hole, 14 such as a slot—where by contrast with this, the hole length 1 is the longer opening dimension of the hole 14.

As FIG. 3 indicates with regard to the holes 13, the longitudinal separation t between the successive through holes 13 is greater than twice the hole width w of the holes 13 and less than five times the hole width w of the holes 13. This therefore rules out the occurrence of rippling in the strip as the metal strip 2 is undergoing thickness profiling. This stipulation can also easily be applied to the other holes 11, 12, and 14, but this has not been shown in detail in the drawings.

The invention claimed is:

1. A method for producing a thickness-profiled metal strip, comprising:

producing at least one hole passing through a metal strip in a rolling region of the metal strip and, in a subsequent step, longitudinally rolling the metal strip with at least one roller that penetrates into the metal strip in at least one rolling region across its strip width and over the at least one hole, thus producing a thickness profiling at least in a width direction of the metal strip.

2. The method according to claim 1, comprising producing the at least one hole by punching the at least one hole into the metal strip.

3. The method according to claim 1, comprising producing the at least one hole by producing at least one row of holes in a longitudinal direction of the metal strip.

4. The method according to claim 3, comprising producing at least two of the holes of the at least one row of holes in the metal strip in such a way that the at least two holes are offset in the width direction of the metal strip.

5. The method according to claim 3, wherein hole spacings between successive holes of the at least one row of holes are different.

6. The method according to claim 3, wherein a longitudinal separation between two successive holes of the plurality of holes is greater than twice a hole width of one of the two successive holes and less than five times the hole width of one of the two successive holes.

7. The method according to claim 1, comprising producing each of the at least one holes with different cross-sectional shapes in the metal strip.

8. The method according to claim 1, wherein the rolling comprises cold-rolling.

9. The method according to claim 1, comprising producing the at least one hole as a circular hole and/or an oblong hole in the metal strip.

10. The method according to claim 1, wherein the at least one hole essentially closes as a result of the longitudinal rolling.

11. The method according to claim 10, wherein after the longitudinal rolling, the hole is closed through material adhesion by welding.

12. The method according to claim 1, wherein the at least one roller penetrates into the metal strip by a maximum depth of two thirds an initial thickness of the metal strip.

13. The method according to claim 1, comprising cutting the thickness-profiled metal strip to length to form a tailored blank.

* * * * *